United States Patent [19]

Loos

[11] Patent Number: 4,765,074

[45] Date of Patent: Aug. 23, 1988

[54] INSIDE/OUTSIDE DISPLAY WINDOW

[75] Inventor: Jerold C. Loos, Rocky River, Ohio

[73] Assignee: Berkley-Small Manufacturing Company, Inc., Medina, Ohio

[21] Appl. No.: 908,041

[22] Filed: Sep. 16, 1986

[51] Int. Cl.[4] ..... G09F 3/18

[52] U.S. Cl. ..... 40/661; 40/308; 40/312

[58] Field of Search ..... 40/306, 10 R, 16, 312, 40/159

[56] References Cited

U.S. PATENT DOCUMENTS

| | | | |
|---|---|---|---|
| 1,430,980 | 10/1922 | Gideon | 40/10 R |
| 1,452,873 | 4/1923 | Gifford | 40/10 R |
| 1,474,424 | 11/1923 | Maxey | 40/10 R |
| 2,723,474 | 11/1955 | Minter | 40/308 |
| 3,077,689 | 2/1963 | Bundrick | 40/308 |
| 3,436,879 | 4/1969 | Duke | 52/38 |
| 3,677,570 | 7/1972 | Hedu | 40/308 |
| 3,793,756 | 2/1974 | Kay et al. | 40/306 |
| 3,803,738 | 4/1974 | Weiss | 40/306 |
| 3,982,342 | 9/1976 | Moore | 4/5 X |
| 4,217,711 | 8/1980 | Spresser | 40/308 |
| 4,506,776 | 3/1985 | Voegeli | 194/54 |

FOREIGN PATENT DOCUMENTS 484483 3/1969 Switzerland .

*Primary Examiner*—Gene Mancene
*Assistant Examiner*—Wenceslao J. Contreras
*Attorney, Agent, or Firm*—Fay, Sharpe, Beall, Fagan, Minnich & McKee

[57] ABSTRACT

A display window apparatus adapted to selectively display long-term and short-term advertisements on a newspaper rack. The apparatus includes an opening formed through a portion of the front wall of the track. A substantially rigid, transparent member is disposed in covering relation with the opening along an inner face of the rack front wall. A flexible member is associated with a first, rear face of the transparent member for accommodating receipt of long term advertising material therebetween. Plural channel defining members are secured in spaced apart relation to the outer face of the rack adjacent the transparent member for receiving and supporting short-term advertising material therebetween.

12 Claims, 2 Drawing Sheets

FIG. 1
(PRIOR ART)
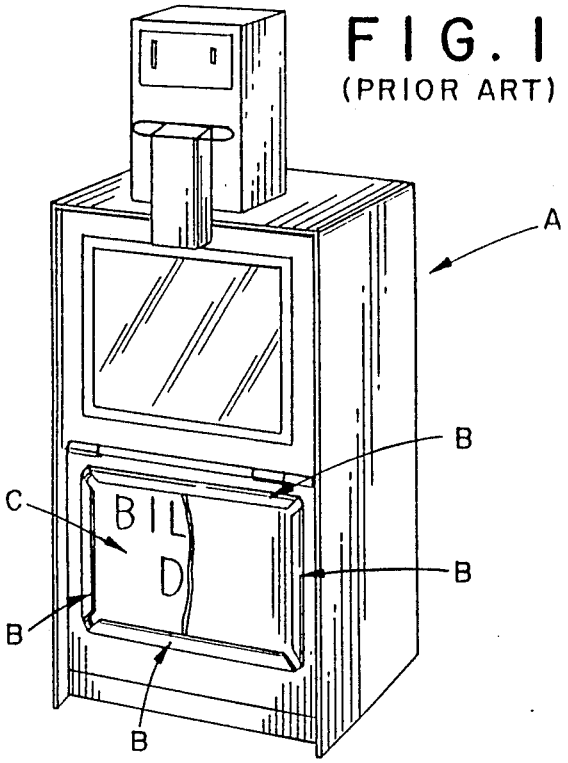
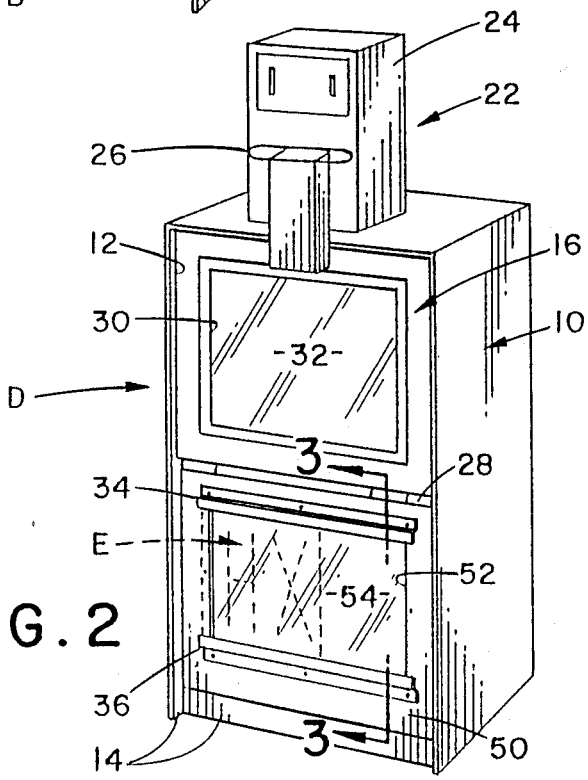
FIG. 2
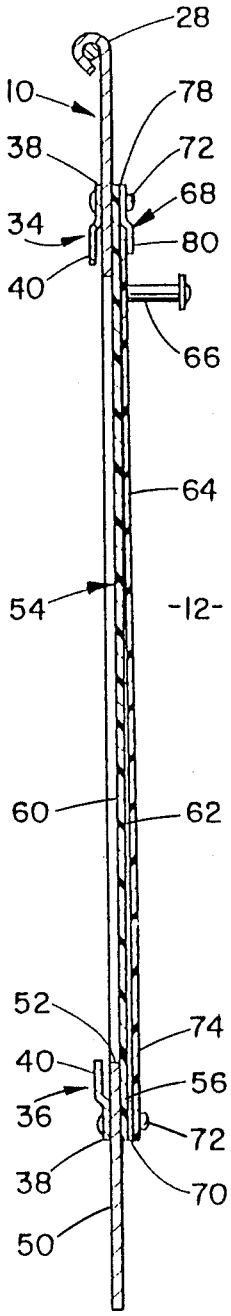
FIG. 3

INSIDE/OUTSIDE DISPLAY WINDOW

BACKGROUND OF THE INVENTION

This invention pertains to the art of newspaper racks and more particularly, to improved advertising and display arrangements for such racks.

The invention is particularly applicable to coin-operated newspaper racks and will be described with particular reference thereto. However, it will be appreciated that the invention has broader applications and may be advantageously adapted to use in other types of racks or environments where it is desired to display advertising literature.

Typically, various exterior surface portions of coin-operated newspaper racks and the like are utilized as a means for displaying advertisements, promotional materials, and the like. In the prior art, conventional channel forming members are arranged to define a generally rectangular card holder adapted to receive advertising material therein. In some cases, the card holder is constructed so that all of the channel forming members are closed. Alternatively, the top of the rectangular configuration is left open to allow easy insertion and removal of advertising cards. These advertising cards take the form of generally planar sheets and are sufficiently flexible to permit insertion of respective peripheral edges into the channel forming members that define the card holder. When so mounted, the advertising card is essentially flush against the outer surface of the newspaper rack.

Although widely used, these foregoing types of display arrangements are considered to be for generally short-term use. Frequent changeover of the advertising cards is expected, so that deterioration due to weather conditions, vandalism, and the like are not a major factor or concern.

On the other hand, it is sometimes desirable to provide long-term display capabilities, so considerations relating to weather conditions, vandalism, and the like become a much larger factor. Prior constructions have utilized display means that protect a newspaper or periodical behind a transparent member. The newspaper is held against an inner face of the transparent member by known means. No accommodation has been made for a long-term advertising structure that can be selectively changed without undertaking a burdensome expense as is involved with painted advertisements or the like. Prior racks that permit short-term or long-term advertising were of entirely different designs and, therefore, the type of advertising permitted at any location was determined by the design of the particular rack stationed there. This has reduced somewhat the ability to fulfill both short and long-term advertising needs or requirements at all rack locations.

It has, therefore, been considered desirable to provide a structure that can accommodate both short-term and long-term advertising on conventional newspaper racks, vending machines, or the like. The subject invention is deemed to meet these needs and others in an efficient, economical manner.

SUMMARY OF THE INVENTION

The present invention contemplates a new and improved rack arrangement comprised of a single unit that can easily accommodate both short-term and long-term advertising materials.

According to the invention, an apparatus providing for selective display of associated advertisements includes a housing which defines a cavity. A panel of the housing has a first outer surface and a second inner surface disposed in facing relation with the cavity. An opening is provided through the housing panel and a generally transparent member is secured in covering relation with the opening. First means is provided adjacent the transparent member for retaining associated advertising material at a first face of the transparent member. A second means is provided for retaining other or alternative advertising material at a second face of the transparent member.

According to a more limited aspect of the invention, the second retaining means includes a flexible member disposed in facing relation with the transparent member first face. This flexible member is adapted for selective shifting movement in order to receive and retain associated long-term type of advertising material between it and the transparent member first face.

According to yet another aspect of the invention, the second retaining means includes elongated channel defining means adjacent the opening adapted to receive the flexible member therein in a closed, retaining position for long-term advertising material.

According to another aspect of the invention, the flexible member includes means for allowing selective manipulation thereof into and out of facing relation with the transparent member.

A primary advantage of the subject invention resides in the advertising versatility provided for article dispensing apparatus such as newspaper racks, vending machines, and the like.

Yet another advantage is found in the ease of converting between long-term and short-term advertising materials.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 1 is a perspective view of a conventional prior art newspaper rack;

FIG. 2 is a perspective view of a newspaper rack incorporating the dual display window formed in accordance with the teachings of the subject invention;

FIG. 3 is a cross-sectional view of the new display window taken generally along the lines 3—3 of FIG. 2; and, FIG. 4 is an exploded, perspective view particularly illustrating the structural components of the subject invention.

DETAILED DESCRIPTION OF THE PREFERRED EMBODIMENT

Figure 4:
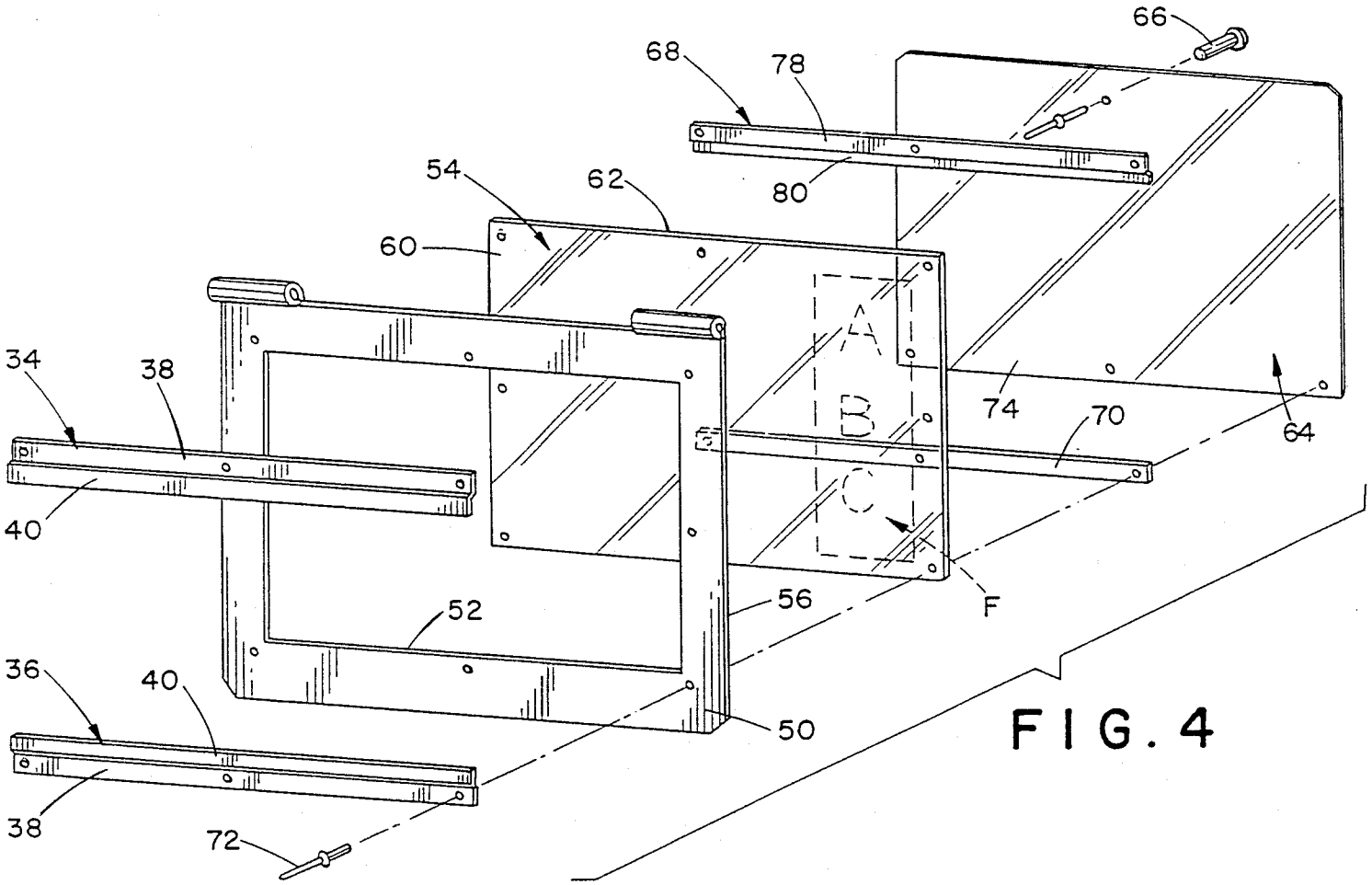

Referring now to the drawings wherein the showings are for purposes of illustrating the preferred embodiment of the invention only and not for purposes of limiting same, a typical, prior newspaper rack A is illustrated in FIG. 1, and is shown as incorporating means for mounting short-term advertising material along an exterior portion thereof. One commonly used arrangement for this mounting means comprises plural pairs of elongated channel forming members B arranged in parallel, spaced-apart relation at some convenient area of the rack housing front face. Members B are adapted to receive and retain a short-term advertisement C for display purposes. For example, the short-term advertisement may be constructed from inexpensive material such as stiff paper, cardboard, or the like. Generally, because of the anticipated short life, there is very little concern given to the effects of inclement weather, vandalism, and the like on the advertisements. Although these short-term advertisements have met with commercial success, they are simply not well suited for long term display as is desired by some advertisers.

At the other extreme, permanent advertising can be painted on the exterior surface of the housing panel. Although not as prone to the destructive effects of the weather, it necessarily "ties-up" the advertising space to a single client. Potential clients or advertisers are wary of the amount of advertising investment involved, and the owner of the rack must remove the rack from the street and undertake an expensive refurbishing process in order to change advertisements when and as desired.

The subject new newspaper rack D as illustrated in FIGS. 2–4 is preferably coin-operated and typically found on street corners and other public areas for vending newspapers or other periodicals. The newspaper rack incorporates both short-term advertising E (FIG. 2) and long-term advertising F (FIG. 4) in addition to dispensing newspapers.

The newspaper rack D includes an essentially hollow housing 10 which defines an internal newspaper storage cavity 12. Plural leg or base members 14 support the rack on the ground or other suitable base area that can take many different forms as is known in the art. A selectively openable door 16 located at the forward or front face of the housing 10 provides access to the cavity 12. A predetermined supply of newspapers or the like (not shown) is stacked inside the container for accommodating purchasers. As shown in FIG. 2 and as will be described below, door 16 comprises approximately the upper one-half of the front face of housing 10 and is mounted for pivotal movement about a horizontal axis. However, it is to be appreciated that the subject invention may be adapted to use with other access door conformations and mountings without in any way departing from the overall intent or scope thereof.

A coin-actuated locking mechanism 22 is fixedly secured to the newspaper rack to control opening and closing of the door 16. The locking mechanism includes a coin box 24 into which a potential purchaser supplies the necessary coinage to release the locking mechanism. Handle 26 extends from the door and is adapted for grasping by a purchaser to pivot the door about hinge mechanism 28 disposed at the lower end of the door. A newspaper may then be removed from the interior of the housing. The door is thereafter returned to its original, closed position under the influence of a conventional spring mechanism (not shown). The action of the coin-actuated locking mechanism is conventional and forms no part of the subject invention so that further discussion herein is deemed unnecessary to a full and complete understanding of the subject invention.

Oftentimes, an opening 30 in the door is covered with a transparent member to form a window 32. This window allows display of selected portions of a newspaper for attracting potential purchasers. Once the stack of newspapers maintained in the cavity 12 has been depleted, the window copy may be taken by the last purchaser to provide a positive indication that the rack has been emptied. This type of arrangement is also known in the art.

Between the foregoing extremes of short-term and permanent advertising as described above, is the need for long-term advertising that can be altered without undue expense. Such result is made possible by the subject invention as illustrated in FIGS. 2–4. Channel forming members 34, 36 are disposed in generally parallel, spaced apart relation horizontally of the housing. Each channel forming member includes a first portion 38 adapted for mounting the members 34 or 36 and a second portion 40 disposed in spaced relation from housing lower panel 50 (FIG. 3). The second portion 40 of each channel forming member is generally parallel to the channel member first portion for selectively receiving the short-term advertising material E.

Although the channel forming members are illustrated in a generally horizontal disposition along housing front face 50, an alternate vertical arrangement could be used without departing from the scope and intent of the subject invention. The short-term advertising material E is shown in phantom and represented as only partially extending the width dimension defined by the channel forming members. This representation is merely for ease of illustration and one skilled in the art will recognize that the short-term advertisement can be of various sizes and configurations. Preferably, however, the advertisement E extends substantially the full length and width of the channel area.

In accordance with the embodiment of FIGS. 2–4, an opening 52 is provided in the housing lower panel 50. This opening is generally rectangular and is dimensioned to accommodate fairly large advertisements viewable from some distance away. Indeed, because the rack is dimensioned for dispensing conventionally sized newspapers, opening 52 may be approximately the size of a conventionally folded newspaper signature. The channel forming members 34, 36 are closely spaced to the opening and do not interfere with mounting a transparent member such as window 54.

According to the preferred embodiment, and with particular reference to FIG. 3, the window 54 is secured to an inner surface 56 of the housing lower panel 50. The window comprises a substantially rigid structure that is capable of withstanding abuse and having an extended useful life. The window is positioned to completely cover the opening 52. More specifically, a first face 60 of the window abuttingly engages the housing panel inner surface 56. A second, opposed face 62 of the window faces inwardly toward cavity 12. In the preferred embodiment, a polycarbonate plastic is used for the window construction. While this plastic has physical characteristics which are advantageous to such application, other plastic materials could also be used satisfactorily.

The window second face is adapted for cooperative relation with a flexible member 64. Here, too, the flexible member is preferably of polycarbonate plastic construction, but is of a type or formulation that allows manual flexure to facilitate installation into and removal from engagement with the window second face 62 in a manner to be described. A long-term advertisement F, represented in phantom in FIG. 4, may be securely held between the window second face and flexible member. The window 54 protects the long-term advertisement from the outside elements, and the flexible member 64 provides a convenient vehicle for retention and for selective insertion and removal.

To facilitate manipulation of the flexible member, a knob or handle 66 is secured thereto. Further, and as is apparent from FIG. 3, a channel forming member 68 extends from the panel inner surface 56 in overlying relation with the peripheral edge portions of the window and flexible member. A spacer bar 70 is disposed in generally parallel, spaced relation to channel forming member 68 adjacent to and intermediate the lower peripheral edge portions of the window and flexible member.

The window 54, channel forming member 68, spacer 70, and flexible member 64 are mounted against the body panel inner surface through use of suitable fasteners 72 such as rivets or the like. Only one such fastener 72 is shown in FIG. 4 for ease of illustration, although it is understood that plural fasteners may be used as necessary to assure a secure arrangement. Only the lower edge portion 74 of the flexible member is retained by the fasteners so that the flexible member can be "peeled" back from a close facing relation with the window second face 62. In accordance with the preferred embodiment, channel forming members 34, 36 are likewise mounted by these same fasteners, although separate fasteners may be used for this purpose if so desired. A first portion 78 of the channel forming member is mounted flush against the window second face while a second portion 80 is spaced therefrom in a manner similar to the conformation of channel forming members 34, 36. The spaced relationship between the second portion 80 and the window second face is designed to receive at least the upper edge area of the flexible member 64 therein (FIG. 3), and may also receive the upper edge area of the long-term advertisement itself.

Thus, in accordance with the subject invention, a short-term advertisement E may be placed in overlying relation with the window first face 60 and retained in position between channel forming members 34 and 36 (FIG. 2). If a long-term advertisement is desired, the short-term advertisement E is removed from the external face of the panel 50 and the door 16 opened to provide access to the flexible member 64. With the assistance of handle 66, the flexible member is "peeled" away from retained engagement with channel forming member 68, the secured lower edge portion 74 acting as a hinge. In this condition, a long-term advertisement F may be inserted between the window and flexible member. The upper edge of the flexible member may then be re-inserted into channel forming member 68 to thereby capture the advertisement. In this manner, the long-term advertisement is located inside the rack housing and is protected from the effects of weather or vandalism.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. An apparatus adapted to selectively display associated advertisements or the like on a newspaper rack, said apparatus comprising:

a housing defining an interior cavity and including a housing panel defining a sidewall thereof, said panel having a first outer surface and a second inner surface adapted for facing relation with said cavity;

an opening of predetermined conformation formed in said housing panel;

a generally transparent window-like member disposed in covering relation with said opening and having opposed first and second faces;

first means adapted for retaining a first associated advertisement adjacent and in at least partially overlying relation to said window-like member first face for viewing the first associated advertisement from said first outer surface of said panel; and second means adapted for retaining a second associated advertisement adjacent and in at least partially overlying relation to said transparent member second face for viewing the second associated advertisement from said first outer surface of said panel.

2. The apparatus as defined in claim 1 wherein said window-like member abuttingly engages said housing panel second surface.

3. The apparatus as defined in claim 1 wherein said first retaining means includes elongated channel defining members disposed around said opening for receiving an associated short-term advertisement.

4. The apparatus as defined in claim 1 wherein said second retaining means includes a flexible member in facing relation with said window-like member and adapted to receive an associated long-term advertisement therebetween.

5. The apparatus as defined in claim 4 wherein said second retaining means further includes an elongated channel defining member disposed around said opening for receiving said flexible member and associated long-term advertisement.

6. The apparatus as defined in claim 4 wherein said flexible member includes means for manipulating said flexible member into and out of facing relation with said window-like member.

7. An apparatus adapted to selectively display associated advertisements or the like on a newspaper rack, said apparatus comprising:

a housing having a cavity defined therein;

an opening formed through a portion of said housing;

a substantially rigid, transparent member having opposed first and second faces disposed in covering relation to said opening along an inner face of said housing;

means associated with said first face of said transparent member for receiving an associated short-term advertisement in at least partially covering relation therewith, the associated short-term advertisement being viewable from the exterior of said housing; and, a flexible member cooperatively associated with said housing for retaining an associated long-term advertisement in at least partially overlying relation to said second face of said transparent member, the associated long-term advertisement being viewable from the exterior of said housing.

8. The apparatus as defined in claim 7 wherein said flexible member includes a handle adapted to facilitate selective manipulation of said flexible member relative to said transparent member.

9. The apparatus as defined in claim 8 further comprising a channel defining member secured to said housing adjacent said transparent member second face for facilitating retention of said long-term advertisement between said flexible member and transparent member second face.

10. The apparatus as defined in claim 7 wherein said receiving means includes channel defining members secured to said housing adjacent said transparent member first face to facilitate retention of said short-term advertisement therein.

11. An apparatus adapted to selectively display short-term and long-term advertisements on a newspaper rack, said apparatus comprising:

a housing having a cavity defined therein, and including a housing panel having an opening extending therethrough;

a window member having first and second opposed faces secured in covering relation to said opening;

first channel forming members peripherally arranged at said opening for retainingly receiving an associated short-term advertisement adjacent said window first face for viewing from the exterior of said housing;

a second channel forming member peripherally arranged at said opening on an opposite side of said housing panel from said first channel forming members; and, a flexible member adapted for selective receipt in said second channel forming member in facing overlying relation with said window second face for selectively retainingly receiving an associated long-term advertisement therebetween for viewing from the exterior of said housing.

12. The apparatus as defined in claim 11 wherein said flexible member is secured along one edge portion thereof to said housing.

* * * * *